US006289194B1

(12) United States Patent
Endo et al.

(10) Patent No.: US 6,289,194 B1
(45) Date of Patent: Sep. 11, 2001

(54) TONER CARTRIDGE AND IMAGE FORMING APPARATUS

(75) Inventors: Minoru Endo; Katsumi Yawata; Eiji Kurosawa, all of Ueda (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/574,228

(22) Filed: May 19, 2000

(30) Foreign Application Priority Data

Oct. 15, 1999 (JP) ..... 11-293277

(51) Int. Cl.[7] ..... G03G 15/08

(52) U.S. Cl. ..... 399/258; 399/106; 399/113; 399/119

(58) Field of Search ..... 399/103, 105, 399/106, 111, 113, 119, 120, 258, 260, 262; 430/120; 222/DIG. 1

(56) References Cited

U.S. PATENT DOCUMENTS 5,179,414 * 1/1993 Bhagat ..... 399/258

FOREIGN PATENT DOCUMENTS 61-45257 * 3/1986 (JP) .
62-2281 * 1/1987 (JP) .
63-26670 2/1988 (JP) .
63-286870 * 11/1988 (JP) .
4-467 1/1992 (JP) .
5-265316 10/1993 (JP) .
6-130740 5/1994 (JP) .
10149017 6/1998 (JP) .

OTHER PUBLICATIONS

English Abstract of Japanese Patent Publication No. 6–130740.

* cited by examiner

*Primary Examiner*—Sophia S. Chen
(74) *Attorney, Agent, or Firm*—Greenblum & Bernstein P.L.C.

(57) ABSTRACT

A toner cartridge of the present invention is provided with toner storage box 201 having opening 202 to supply toner particles stored therein outside, and toner supply roller 208, provided at a position such that the roller covers opening 202 in the vicinity of opening 202, of which a surface is made of a soft porous material.

15 Claims, 10 Drawing Sheets

TONER CARTRIDGE AND IMAGE FORMING APPARATUS

BACKGROUND OF THE INVENTION

1. Field of the Invention

The present invention relates to a toner cartridge to perform an image formation, image forming apparatus provided therewith, and toner cartridge recycling method.

2. Description of the Related Art

Conventionally there has been an image forming apparatus that selectively exposes a uniformly charged photoconductive material to form a toner image, transfers the toner image to a recording medium, and thereby performs an image formation. In order to simplify the toner replenishment operation in such an image forming apparatus, there is a toner cartridge formed by assembling a toner storage box, developing roller, exposure roller, and others.

There is further provided in recent years a toner cartridge capable of being separated into a plurality of units in order to exchange only a unit with the toner storage box and reuse reusable components in replenishing the toner. However, such a cartridge has the possibility the toner may leak from the toner cartridge in exchanging the unit with the toner storage box. Then it is considered to cover an opening of the toner storage box with a film to prevent the toner form leaking from the toner storage box. However, this configuration may have the possibility the toner leaks from the toner storage box in exchanging the unit with the film peeled off, in other words, the unit with a used toner storage box.

In order to solve the above problem, it is considered to further provide a magnetic developing roller at a position such that the roller covers the opening of the unit with the toner storage box. Thereby, the magnetic toner assuredly adheres to the developing roller without leaking. As a result, the leak of the toner from the toner storage box is still prevented after the film is peeled off the opening.

However, in the conventional toner cartridge, since it is necessary to provide the unit having the toner storage box with the developing roller, the developing roller is exchanged along with the toner storage box frequently. However, the developing roller is expensive, and it is not necessary to exchange the developing roller frequently because of long life thereof. Therefore, it is inevitable that the expensive developing roller is exchanged frequently and wastefully, resulting in the problem that the running cost of an image forming apparatus is increased, and that the financial burden of users is increased.

SUMMARY OF THE INVENTION

An object of the present invention is to provide a toner cartridge that prevents the toner from leaking from a toner storage box in exchanging the toner cartridge and suppresses the financial burden of users, and an image forming apparatus provided with the toner cartridge.

The toner cartridge of the present invention is provided with the toner storage box having an opening to supply the toner stored therein to the outside thereof, and a toner supply roller with a surface made of a soft porous material, which is provided at a position such that the roller covers the opening in the vicinity of the opening. The toner supply roller with the surface made of the soft porous material can be produced inexpensively.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

Figure 1:
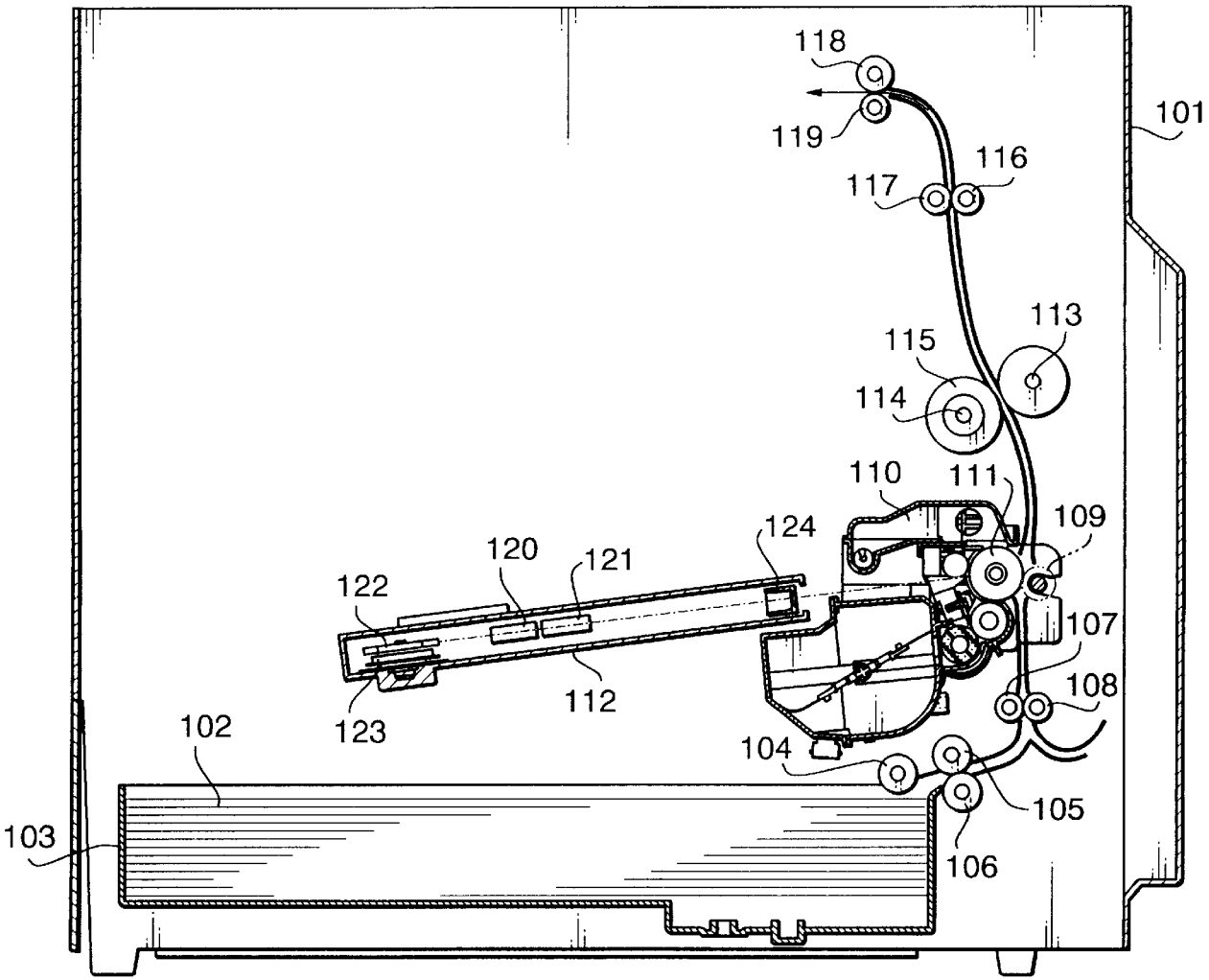
FIG. 1 is a sectional view of an image forming apparatus according to one embodiment of the present invention.

An image forming apparatus according to one embodiment of the present invention will be described below specifically using accompanying drawings. FIG. 1 is a perspective view of the image forming apparatus according to the above embodiment.

In FIG. 1, an apparatus denoted with "101" is the image forming apparatus according to the above embodiment. Image forming apparatus 101 is provided, in the vicinity of a bottom thereof, with paper cassette 103 that stores a plurality of sheets of recording paper 102. Pick-up roller 104 is provided above paper cassette 103.

Pick-up roller 104 picks up recording paper placed on paper cassette 103 from the top sheet, and feeds the paper to a pair of separate rollers 105 and 106 provided at a downstream side from pick-up roller 104 in the direction of the paper feed.

When pick-up roller 104 feeds a plurality of sheets of recording paper 102 unexpectedly, separate rollers 105 and 106 separate the plurality of sheets one by one, and feed the sheet to a pair of register rollers 107 and 108 provided at a downstream side from separate rollers 105 and 106 in the direction of the paper feed.

Register rollers 107 and 108 rotate in response to image forming operation, and thereby feed the recording paper to a space between transfer roller 109 provided at a downstream side from the register rollers in the direction of the paper feed and photoconductive roller 111 provided in toner cartridge 110. Register rollers 107 and 108 adjust a recording start position on photoconductive roller 111 to a recording start position on recording paper 102.

Photoconductive roller 111 forms a latent image by being exposed from optical unit 112, and further forms a toner image corresponding to the latent image, on a surface thereof. In addition, a photoconductive roller is used as a photoconductive material in this embodiment, but it may be possible to use a photoconductive material of which the form is not a roller.

Transfer roller 109 is applied a voltage of inverse polarity to the toner image formed on photoconductive roller 111. Transfer roller 109 presses recording paper 102 against photoconductive roller 111, and thereby the toner image on photoconductive roller 111 is transferred to recording paper 102.

Light source unit 112 is provided with laser diodes 120 and 121. Laser diodes 120 and 121 irradiate a light corresponding to a signal of an image to be recorded on recording paper 102 to polygon mirror 122 provided around an end portion of light source unit 112 in the direction opposed to toner cartridge 110. Polygon mirror 122 rotates fast by scanner motor 123, and reflects the irradiated light to the direction of photoconductive roller 111. The light reflected by polygon mirror 122 is irradiated to photoconductive roller 111 through imaging lens 124 provided at the other end portion of light source unit 112, which is at a side of toner cartridge 110. Photoconductive roller 111 is exposed by this light.

The toner image on the surface of photoconductive roller 111 is transferred to recording paper 102, which is fed to a space between transfer roller 109 and photoconductive roller 111, by transfer roller 109. Thereafter, recording paper 102 is fed to a space between drive roller 113 and fixing roller 115 each provided at a downstream side from transfer roller 109 in the direction of the paper feed.

Fixing roller 115 is provided with heater 114 therein. When recording paper 102 is passed through the space between drive roller 113 and fixing roller 115, recording paper 102 is applied heat by fixing roller 115, while being pressed by drive roller 113 and fixing roller 115. Thereby, the toner on recording paper 102 is fixed thereon.

Recording paper 102 with the toner fixed thereon is fed to a space between intermediate discharge rollers 116 and 117 provided at a downstream side from fixing roller 115 in the direction of the paper feed. Then, recording paper 102 fed to the space between intermediate discharge rollers 116 and 117 is fed to a space between discharge rollers 118 and 119 provided at a further downstream side in the direction of the paper feed, and then discharged to the outside of image forming apparatus 101.

The image forming apparatus in the above embodiment forms image data on the recording paper as described above.

Figure 2:
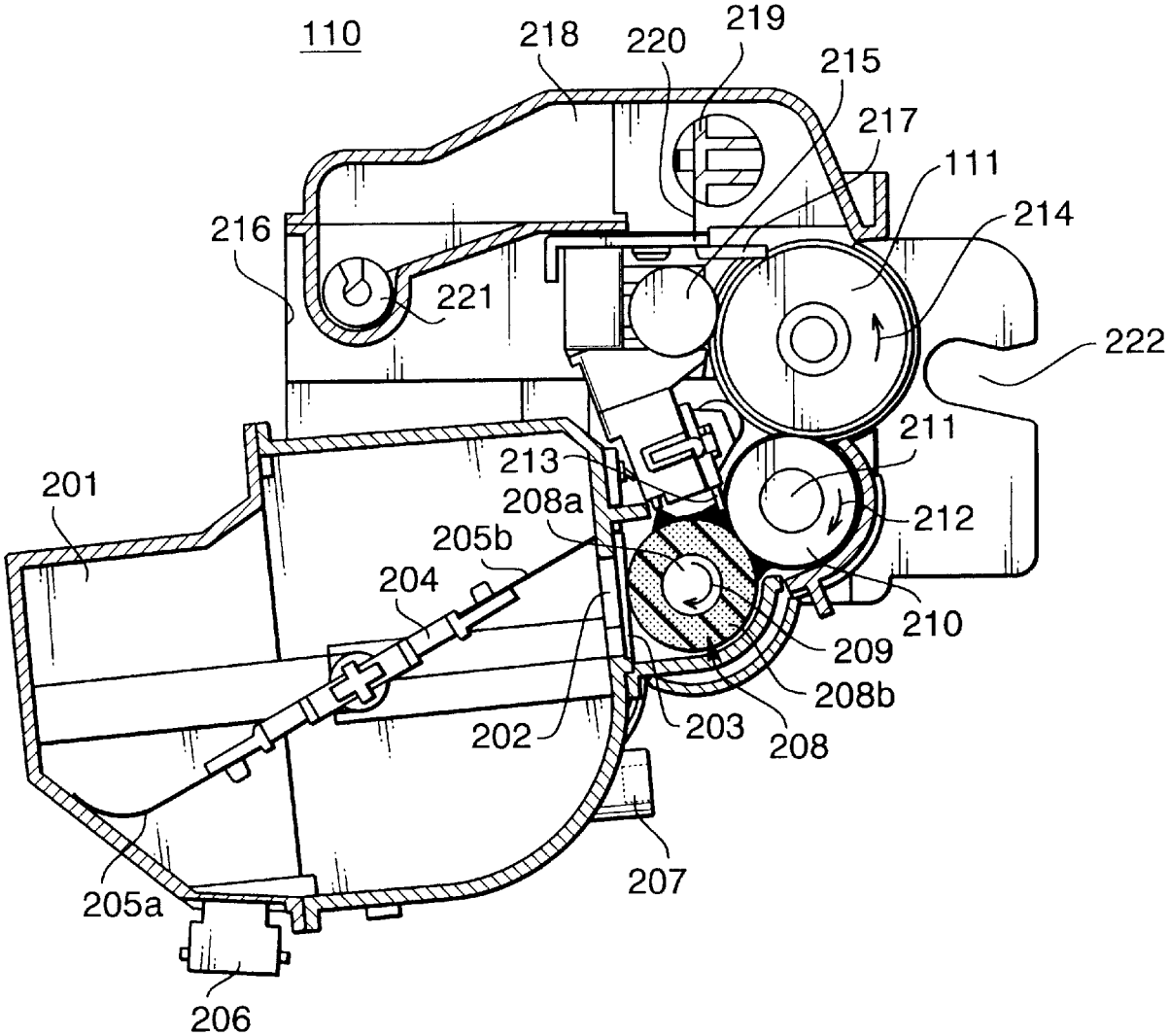
FIG. 2 is a sectional view of a toner cartridge of the image forming apparatus illustrated in FIG. 1.

A structure of the toner cartridge according to the above embodiment is next explained. FIG. 2 is a sectional view of the toner cartridge according to the above embodiment.

Toner cartridge 110 is provided at a bottom portion thereof with toner storage box 201 that stores magnetic toner particles. Opening 202 is formed at a side portion of toner storage box 201 to supply the toner outside. Toner storage box 201 is provided with film 203 to shield opening 202. Film 203 prevents the toner stored in toner storage box 201 from leaking and getting wet. Toner storage box 201 is further provided inside thereof with toner feeding member 204 that rotates on generally the center portion of toner storage box 201. Since films 205*a* and 205*b* are attached respectively to opposite end portions of toner feeding member 204, toner feeding member 204 can stir the entire toner in toner storage box 201 and feed the toner to opening 202.

Toner storage box 201 is further provided on the bottom surface thereof with toner sensor 206 that detects a residual amount of the toner in toner storage box 201. Thereby, a user can recognize the time toner cartridge 110 should be exchanged.

Toner storage box 201 is furthermore provided with boss member 207 to fix toner cartridge 110 to image forming apparatus 101 at a lower portion of the side at which opening 202 is formed. Boss member 207 has a concavity inside thereof, and a projection (not shown in the figure) provided in image forming apparatus 101 is inserted into the concavity, whereby toner cartridge 110 is fixed to image forming apparatus 101.

Toner supply roller 208 that supplies the toner from opening 202 to an external apparatus is provided at such a position that covers opening 202 in the vicinity of opening 202 of toner cartridge 110, toner supply roller 208 is composed of toner supply roller shaft 208*a* and sponge material 208*b* that is a soft porous material. Toner supply roller shaft 208*a* is coated with sponge material 208*b*. In other words,the surface of the toner supply roller 208 is made of a sponge material that is a soft porous material. The diameter of a pore of the sponge material is made larger than that of a toner particle. Thereby toner supply roller 208 has a high capability of holing toner. As a result, the toner carrying capability of toner supply roller 208 is improved. Further since the sponge material is inexpensive, toner supply roller 208 can be produced inexpensively. Furthermore since the sponge material is easy to process, toner supply roller 208 can be produced easily.

Toner supply roller 208 rotates on the axis thereof in the direction of arrow 209 (clockwise). Thereby the toner inside toner storage box 201 is carried to developing roller 210 provided in contact with to toner supply roller 208.

Developing roller 210 has magnet 211 inside thereof. Since developing roller 210 becomes thereby magnetic, a layer of the magnetic toner particles is formed by a rotation of developing roller 210 in the direction of arrow 212 (clockwise).

Further developing blade 213 is provided in the vicinity of a portion where toner supply roller 208 and developing roller 210 are in contact with each other. Developing blade 213 charges the toner carried by toner supply roller 208, so that the toner adheres to photoconductive roller 111 easily. Further developing blade 213 forms a thin uniform toner layer on a surface of developing roller 210, while regulating the thickness of the toner layer thereon. It is thereby possible for developing roller 210 to perform accurate developing assuredly.

Photoconductive roller 111 is provided at a position neighboring to developing roller 210. Photoconductive roller 111 rotates in the direction of arrow 214 (anticlockwise), and the surface thereof is first charged by charging roller 215 provided in contact with photosensitive roller 111. Charging roller 215 rotates according to the rotation of photoconductive roller 111. Photoconductive roller 111 is next exposed to a light through opening 216 provided at a side portion, at the side of optical unit 112, of toner cartridge 110. A latent image is thereby formed on the surface of photoconductive roller 111. Then, photoconductive roller 111 forms the toner image corresponding to the latent image on the surface thereof with the toner supplied from developing roller 210. Since the roller is assuredly supplied to photoconductive roller 111 from developing roller 210 with the thin uniform tone layer on the surface thereof, photoconductive roller 111 can form a desired toner image assuredly. Then, the toner image is transferred to recording paper 102 by transfer roller 109 illustrated in FIG. 1.

Cleaning blade 217 is provided at a position forward from the position of transfer roller 109 with respect to photoconductive roller 111 in the rotation direction thereof so that part of cleaning blade 217 contacts with photoconductive roller 111. Cleaning blade 217 scrapes off the toner that was not transferred to recording paper 102 on the surface of photoconductive roller 111. Since the toner on the surface of photoconductive roller 111 is thereby removed, photoconductive roller 111 can form a desired latent image assuredly, whereby the desired toner image is assuredly formed.

The toner scraped by cleaning blade 217 is stored in used toner storage box 218 provided above photoconductive roller 111. Used toner feed member 219 is provided in the vicinity of cleaning blade 217 in used toner storage box 218. Film 220 is provided around the periphery of used toner feed member 219, and the used toner is effectively fed to used toner discharge member 221 provided at an inner portion in used toner storage box 218. Used toner discharge member 221 has the form of a screw, rotates on the axis thereof, and thereby discharges the used toner to a used toner collect bottle not shown in the figure. Thus the used toner is discharged to the outside of toner cartridge 110 to be collected.

Cut-out portion 222 is formed in the vicinity of photoconductive roller 111 on a side surface of toner cartridge 110. Transfer roller 109 is inserted into cut-out portion 222, and thereby is positioned and held.

Figure 3:
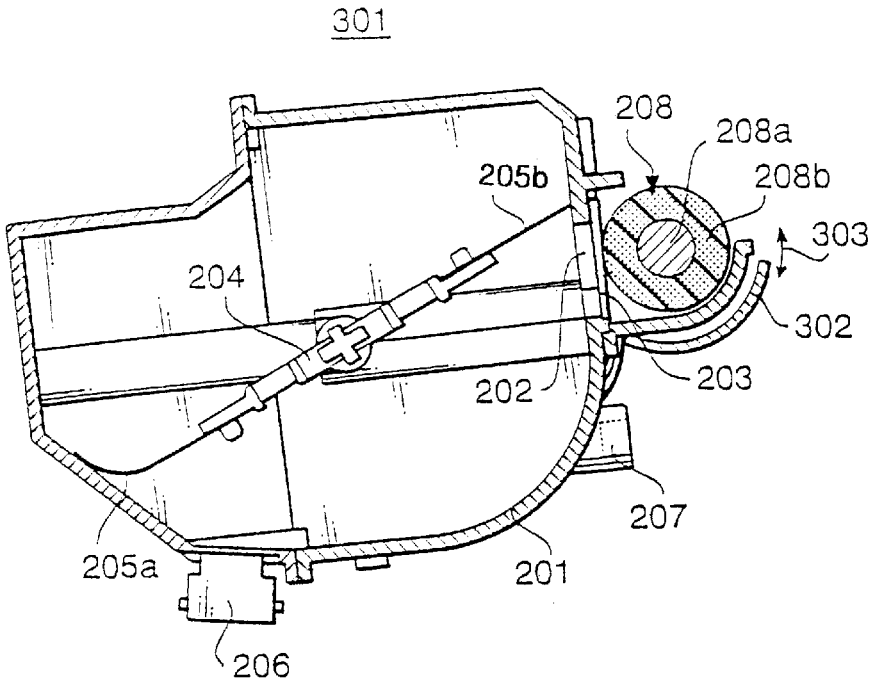
FIG. 3 is a sectional view of a first unit of the toner cartridge illustrated in FIG. 2.
Figure 4:
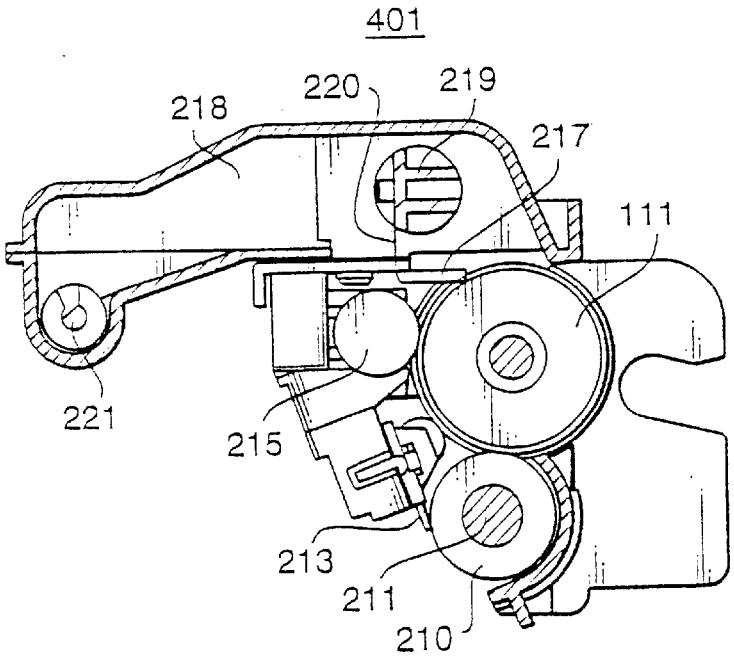
FIG. 4 is a sectional view of a second unit of the toner cartridge illustrated in FIG. 3.

Each unit separated from the toner cartridge of the above embodiment is next explained in detail using FIGS. 3 and 4. FIG.3 is a sectional view of a first unit of the toner cartridge according to the above embodiment. FIG.4 is a sectional view of a second unit of the toner cartridge according to the above embodiment.

Toner cartridge 110 is configured being separable to first unit 301 and second unit 401.

First, unit 301 is provided with components that are exchanged frequently or inexpensive components such as toner storage box 201, toner supply roller 208 and film 203. Meanwhile, second unit 401 is provided with long-life and expensive components such as developing roller 210, photoconductive roller 111, charging roller 215, cleaning blade 217 and used toner storage box 218.

Thus, since it is made possible to separate toner cartridge 110 to first unit 301 and second unit 401, it is possible to exchange a part having toner storage box 201 in replenishing the toner. It is thereby possible to reuse second unit 401 having reusable components such as developing roller 210 and photoconductive roller 111. It is thereby possible to decrease the running cost of image forming apparatus 101, and to reduce the financial burden of users.

In addition, when toner cartridge 110 is separated into first unit 301 and second unit 401, there is the possibility the toner leaks from toner storage box 201. However film 203 provided to shield opening 202 prevents the toner from leaking from toner storage box 201.

Further, at the time of exchanging first unit 301 with film 203 removed, in other words, exchanging used first unit 301, there is the possibility the toner leaks from toner storage, box 201. However, since toner supply roller 208 is arranged at a position such that the roller covers opening 202, toner supply roller 208 functions as a cap to prevent the toner from leaking from toner storage box 201, and thereby prevents the toner from leaking from toner storage box 201. Further, the surface of toner supply roller 208 is made of the sponge material that is the soft porous material with the high capability of holding toner. Toner supply roller 208 thereby effectively prevents the toner from leaking from toner storage box 201.

Furthermore, shutter 302 to protect toner supply roller 208 is provided in the vicinity of toner supply roller 208 in first unit 301. Shutter 302 swings in the direction of arrow 303, in other words, to cover toner supply roller 208. Since toner supply roller 208 is thereby covered with shutter 302, shutter 302 prevents the toner from leaking from toner storage box 201 in case the toner leak that is not prevented by toner supply roller 208 occurs.

Moreover, shutter 302 is applied a force in the direction of covering toner supply roller 208 by forcing means not shown in the figure. Toner cartridge 110 thereby has a configuration such that toner supply roller 208 is automatically covered when separated into first unit 301 and second unit 401.

Figure 5:
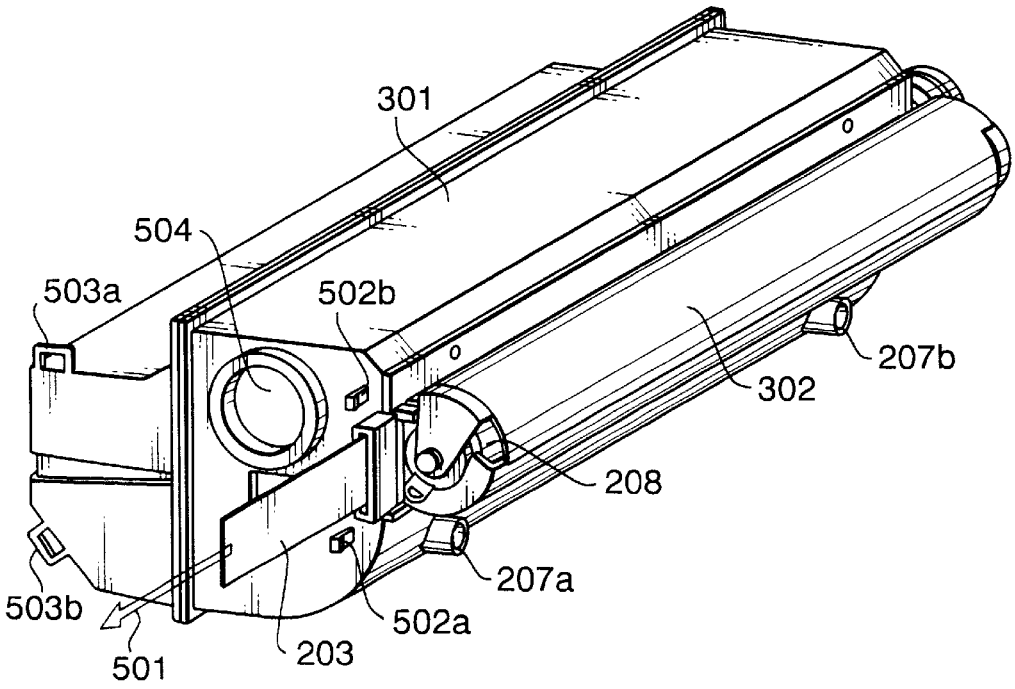
FIG. 5 is a perspective view of the first unit illustrated in FIG. 3 at a first state.
Figure 6:
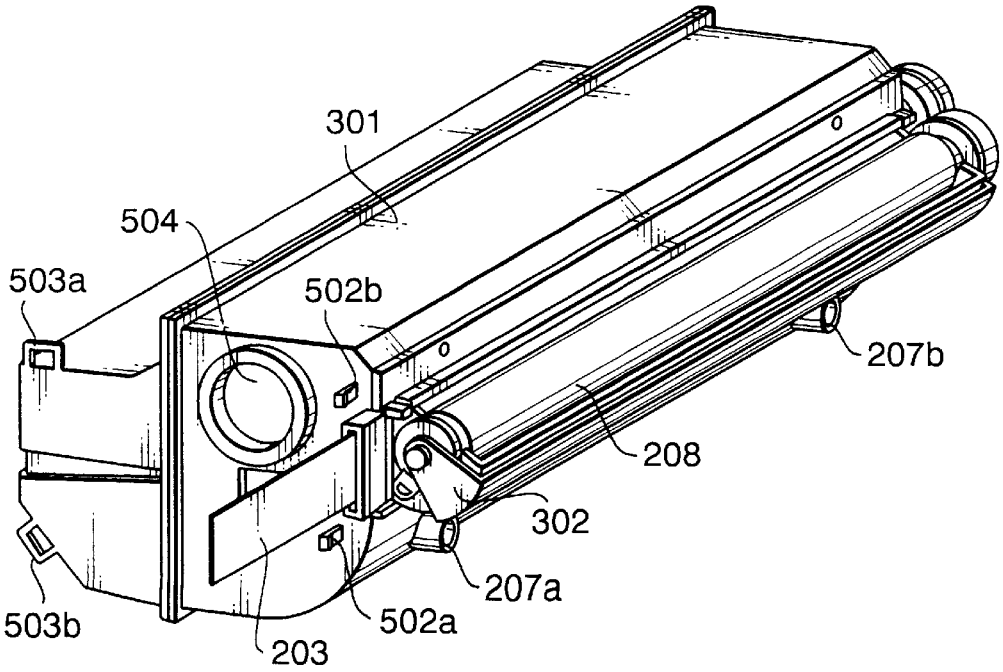
FIG. 6 is a perspective view of the first unit illustrated in FIG. 3 at a second state.

The first unit according to the above embodiment is next explained in further detail using FIGS. 5 and 6. FIGS. 5 and 6 are perspective views of the first unit according to the above embodiment.

FIG. 5 is a diagram illustrating a state in which shutter 302 covers toner supply roller 208. On the other hand, FIG. 6 illustrates another state in which shutter 302 does not cover toner supply roller 208. Thus shutter 302 moves when necessary.

In addition, since film 203 is provided to enable itself to be pulled to the direction of arrow 501, film 203 can be drawn from first unit 301 when necessary.

A pair of bosses 207*a* and 207*b* each is provided at a lower portion of the side surface of first unit 301, Projections of image forming apparatus 101 not shown in the figure are inserted into the pair of bosses 207*a* and 207*b*, whereby first unit 301 is fixed to image forming apparatus 101.

Spur pieces 502*a* and 502*b*, and holes 503*a* and 503*b* are further provided on the side surface of first unit 301 to attach a used toner collect bottle described later. Furthermore toner filling opening 504 is provided on the side surface of first unit 301. Toner filling opening 504 is usually attached a cap. The cap is removed from toner filling opening 504 at the time of toner filling.

Figure 7:
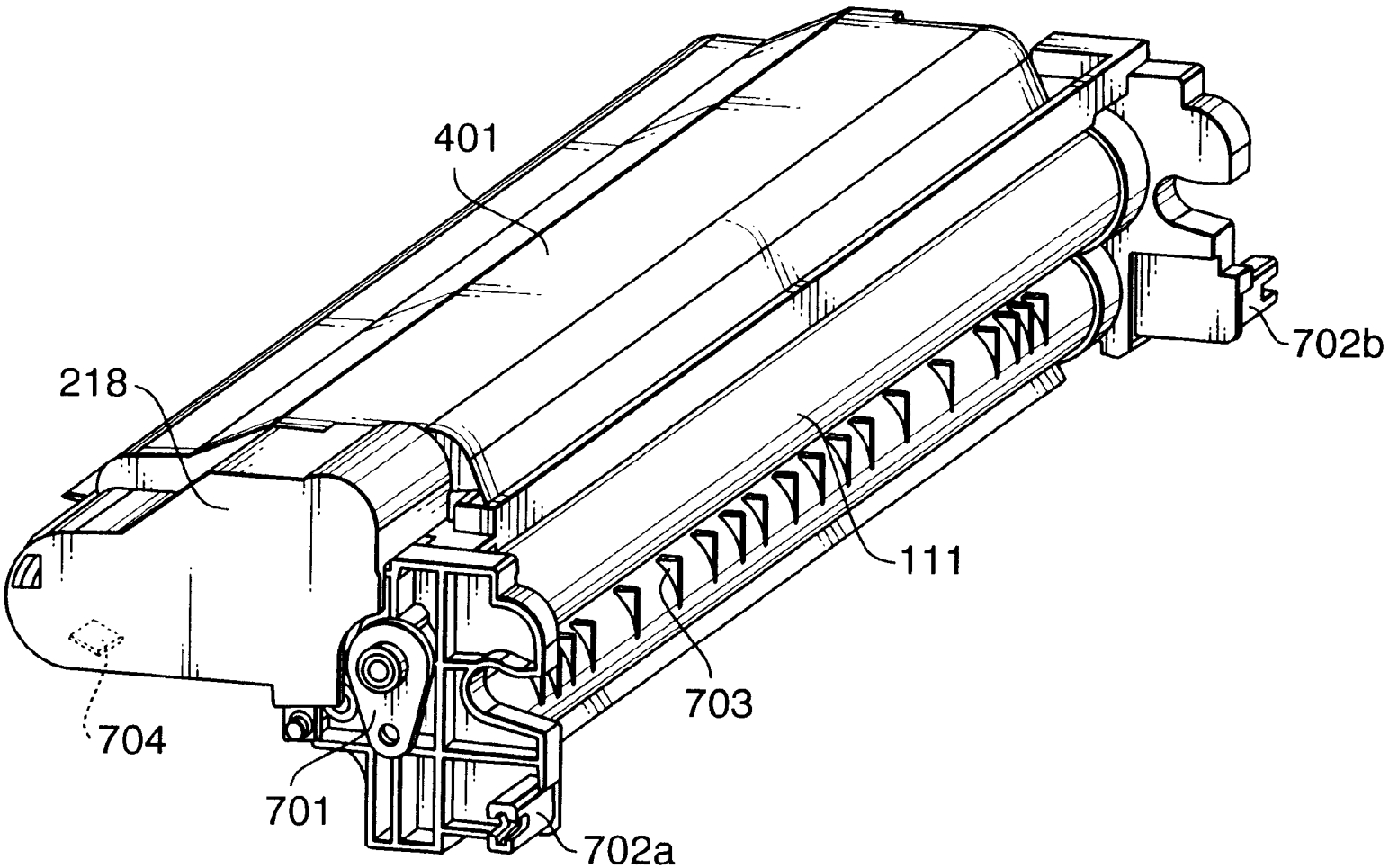
FIG. 7 is a perspective view of a second unit illustrated in FIG. 4.

A configuration of the second unit according to the above embodiment is next explained in further detail using FIG. 7. FIG. 7 is a perspective view of the second unit according to the above embodiment.

Guide 701 is provided on a side surface of second unit 401 at a side of photosensitive roller 111. Guide 701 positions second unit 401 with respect to image forming apparatus 101. Guide 701 is inserted into a dint provided in image forming apparatus 101 not shown in the figure, whereby second unit 401 is positioned with respect to image forming apparatus 101 while being held thereby.

Screw holder 702*a* and 702*b* are provided on opposite side surfaces of second unit 401 to fix second unit 401 to image forming apparatus 101. Screw holder 702*a* is provided in the vicinity of guide 701, and screw holder 702*b* is provided at an opposite position to screw holder 702*a*. Screws are respectively inserted into screw holes, not shown in the figure, provided in image forming apparatus 101 through screw holders 702*a* and 702*b*, whereby second unit 401 is assuredly fixed to image forming apparatus 401.

Thus, first unit 301 and second unit 401 are separately fixed to image forming apparatus 101.

A series of guides 703 each is provided on a side surface of second unit 401 on which recording paper is fed to feed the recording paper without being bent.

Used toner discharge opening 704 is provided at a bottom portion or used toner storage box 218 of second unit 401, at the opposite side to photosensitive roller 111.

Figure 8:
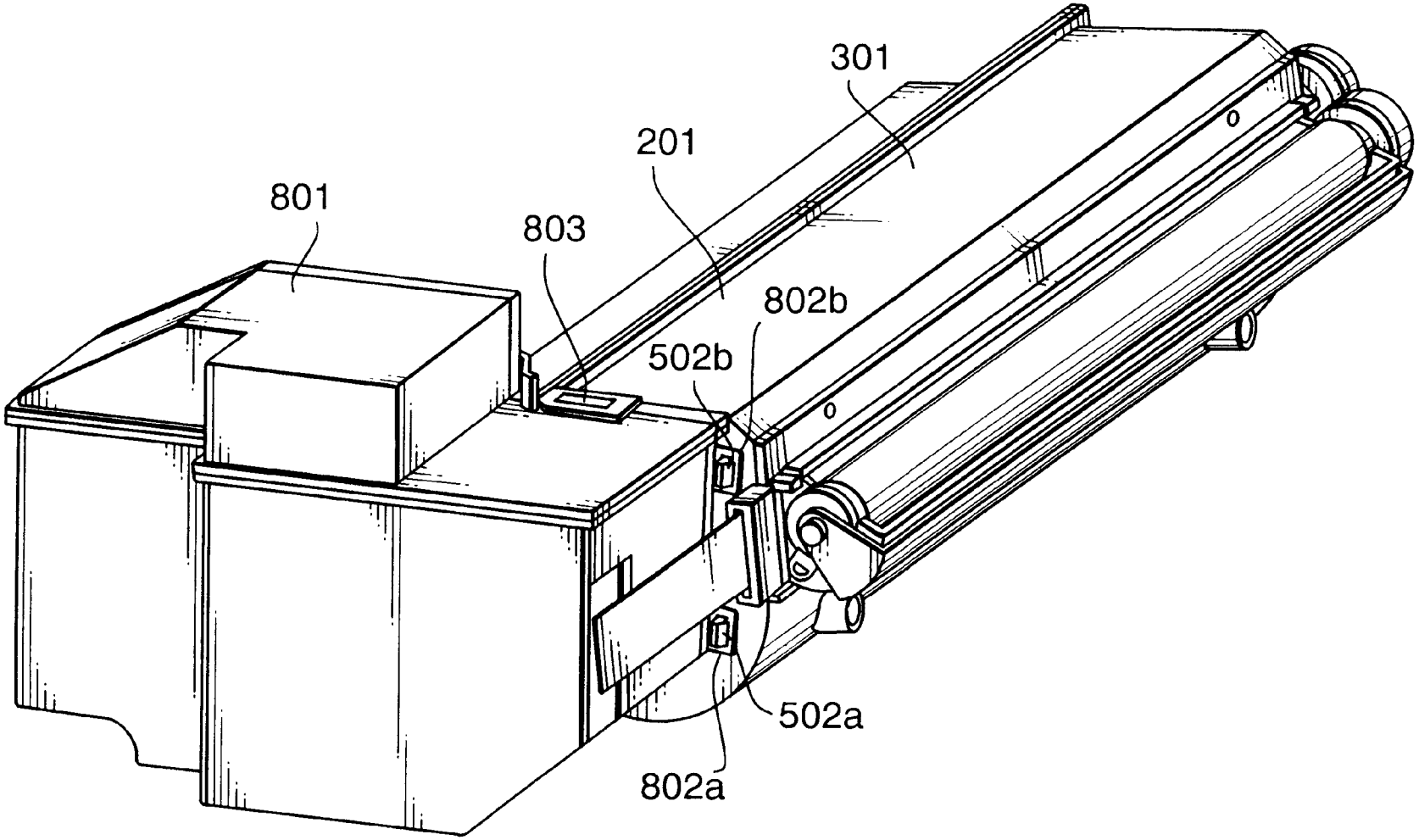
FIG. 8 is a perspective view of the first unit illustrated in FIG. 3 with a used toner collect bottle attached thereto.
Figure 9:
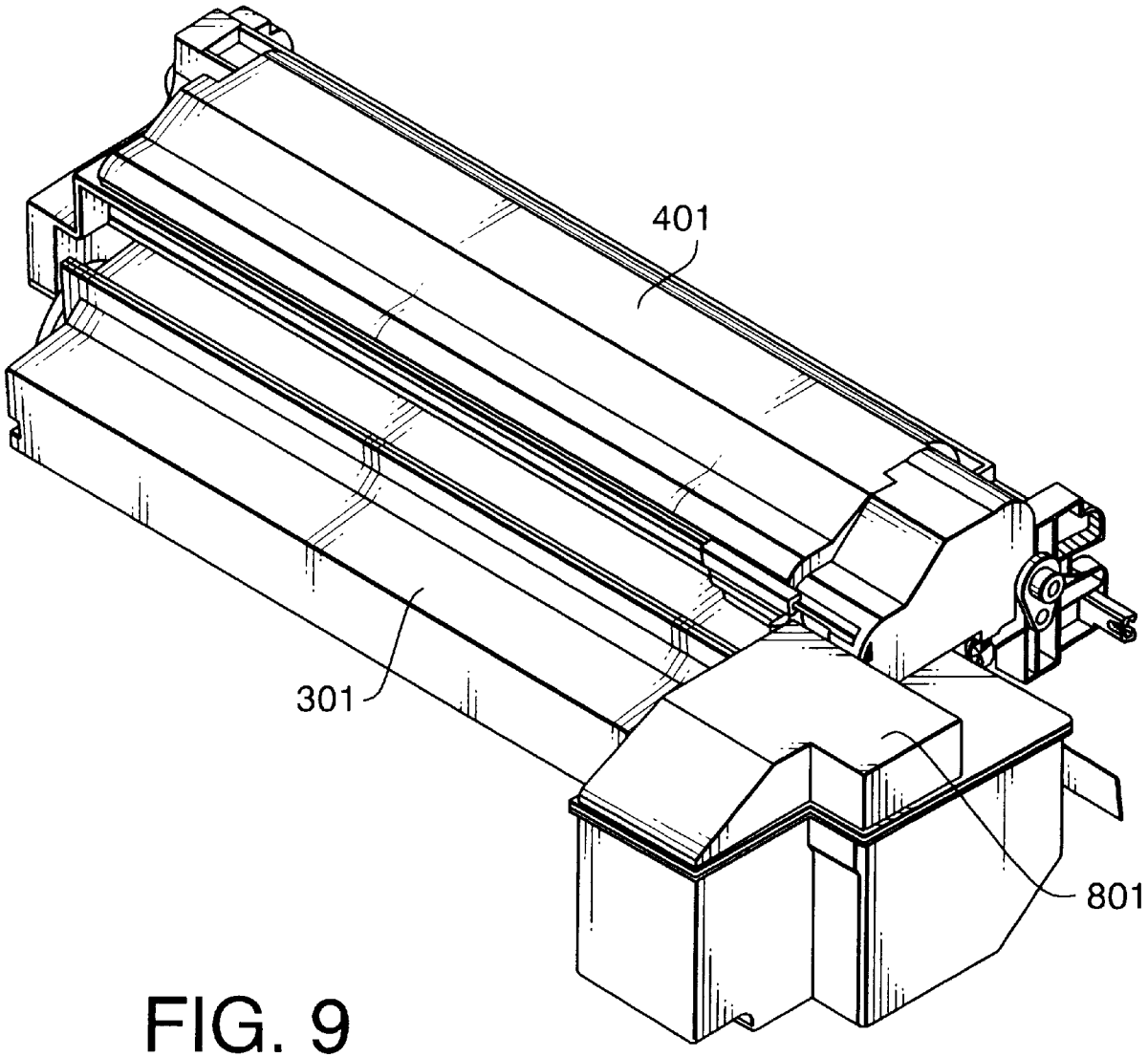
FIG. 9 is a perspective view of a state in which the first unit illustrated in FIG. 3, the second unit illustrated in FIG. 4 and the used toner collect bottle illustrated in FIG. 8 are assembled.

A used toner collect bottle according to the above embodiment is next explained using FIGS. 8 and 9. FIG. 8 is a perspective view of the first unit according to the above embodiment with the unused toner collect bottle attached thereto. FIG. 9 is a perspective view of a state in which first unit 301, second unit 401 and unused toner collect bottle are assembled.

Used toner collect bottle 801 is attached to a side surface of first unit 301. Used toner collect bottle 801 is provided with holes 802*a* and 802*b* at opposite positions respectively to spur pieces 502*a* and 502*b*. Used toner collect bottle 801 is further provided with spur pieces not shown in the figure at opposite positions respectively to 503*a* and 503*b* illustrated in FIG. 5. Spur pieces 502*a* and 502*b* are respectively inserted into holes 802*a* and 802*b*, while the spur pieces not shown in the figure are respectively inserted into holes 503*a* and 503*b*, whereby used toner collect bottle 801 is attached to first unit 301.

Used toner collect bottle 801 is furthermore provided with used toner collect opening 803 at an opposite position to used toner discharge opening 704 of second unit 401. FIG. 9 illustrates a relationship between positions of used toner discharge opening 704 and used toner collect opening 803. Thus the toner discharged from used toner discharge opening 704 is stored in used toner collect bottle 801 from used toner collect opening 803.

Since used toner collect bottle 801 is attached to first unit 301, it is possible to collect used toner collect bottle 801 at the same time as first unit 301 when the toner is consumed in toner storage box 201 in first unit 301. It is also possible to collect only used toner collect bottle 801 and reuse toner collect bottle 801 after the used toner is removed.

Figure 10:
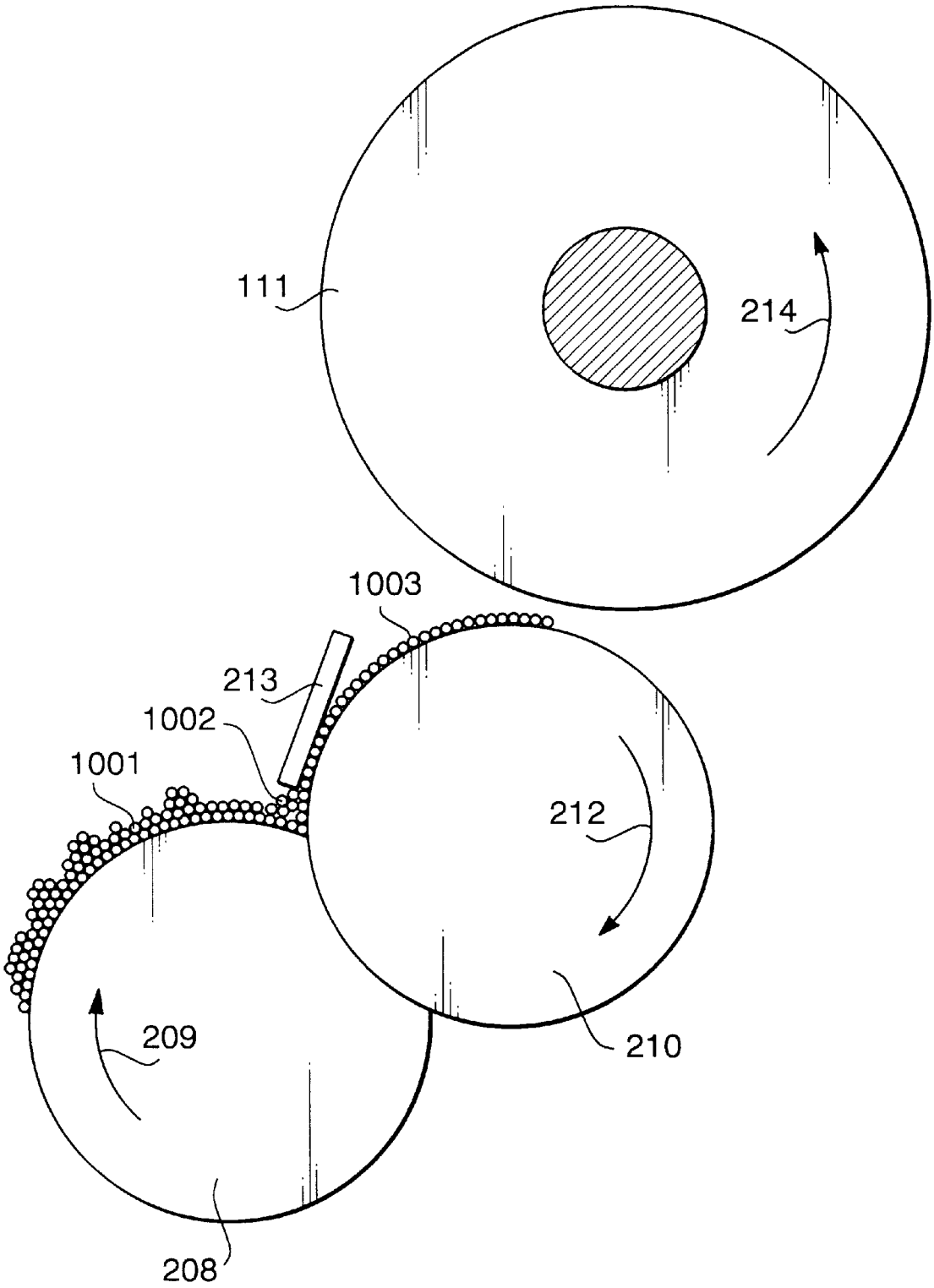
FIG. 10 is an operation diagram illustrating a first state of toner carrying operation of the toner cartridge illustrated in FIG. 2.
Figure 11:
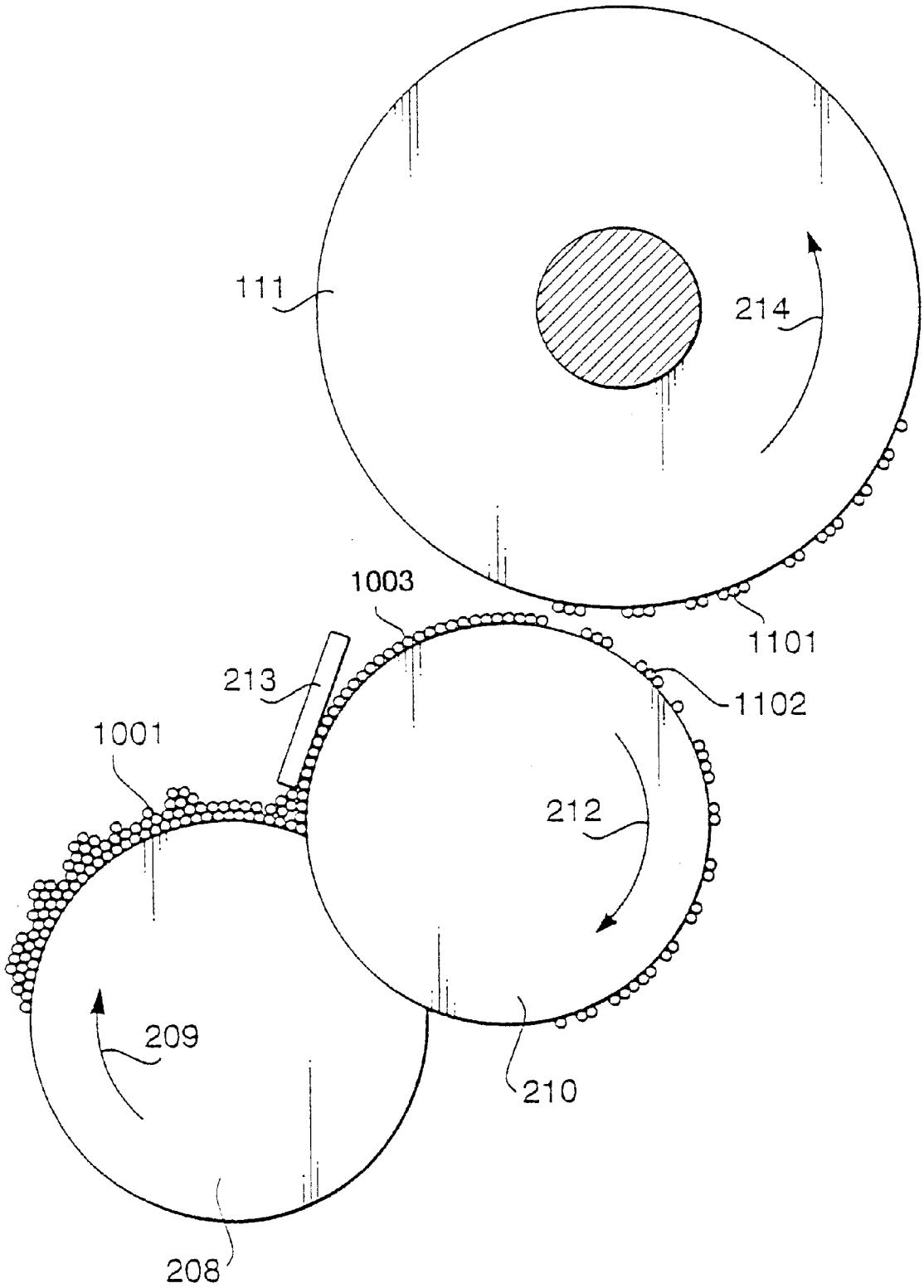
FIG. 11 is an operation diagram illustrating a second state of toner carrying operation of the toner cartridge illustrated in FIG. 2.
Figure 12:
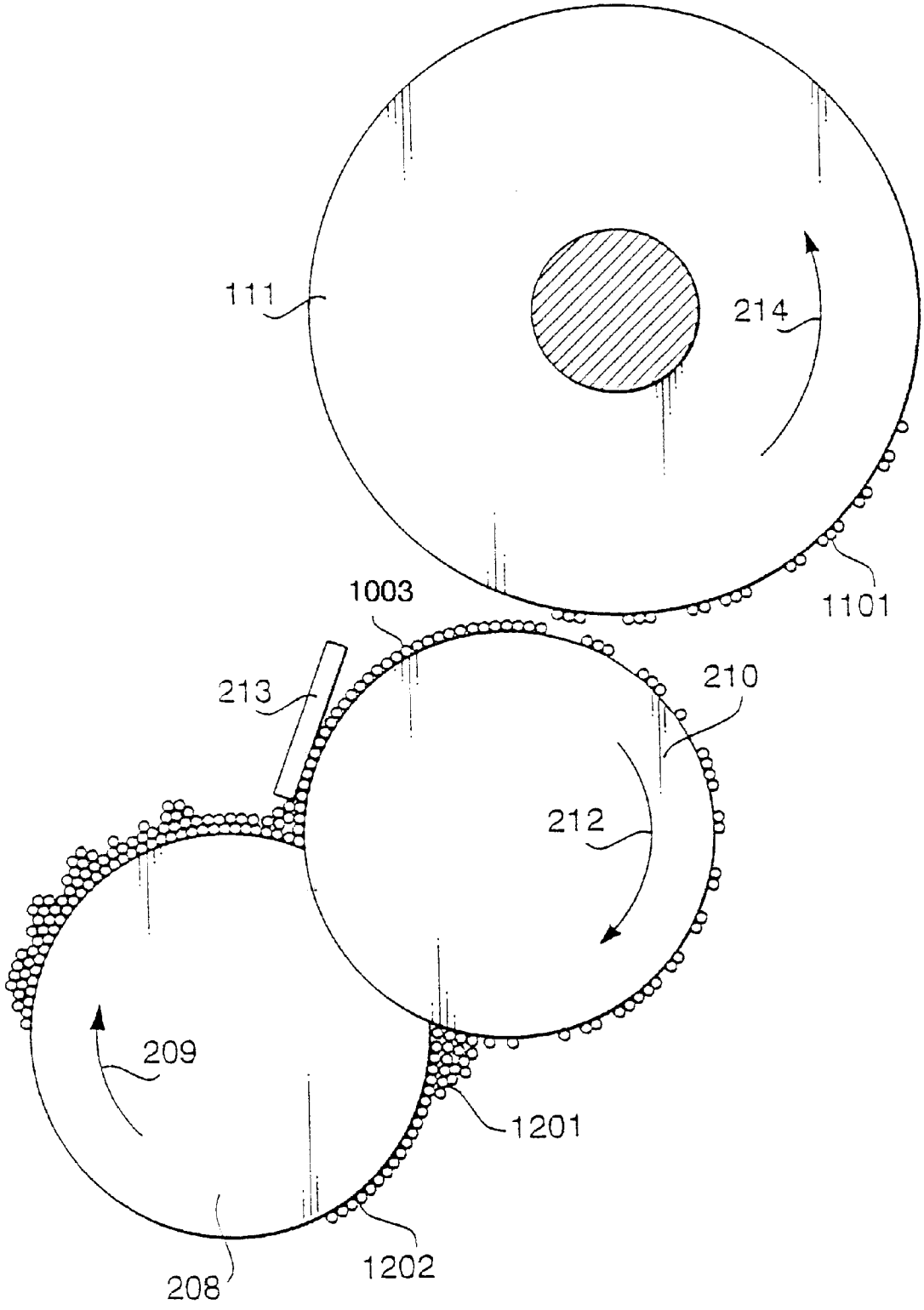
FIG. 12 is an operation diagram illustrating a third state of toner carrying operation of the toner cartridge illustrated in FIG. 2.

The toner carrying operation in the toner cartridge according to the above embodiment is next explained using FIGS. 10 to 12. FIGS. 10 to 12 are operation diagrams illustrating the toner carrying operation in the toner cartridge according to the above embodiment.

First, toner particles in toner storage box 201 enter pores on the surface of toner supply roller 208, and thereby adhere to toner supply roller 208. Toner 1001 adhering to the surface of toner supply roller 208 is fed to a portion where developing roller 210 and toner supply roller 208 contact, by the rotation of toner supply roller 208 on the axis thereof in the direction of arrow 209 (clockwise). Toner 1002, fed to the vicinity of the portion where developing roller 210 and toner supply roller 208 contact, is charged by developing blade 213. Toner 1002 thereby adheres to charged photoconductive roller 111 easily. The rotation direction of developing roller 210 (arrow 212) and that of toner supply roller 208 (arrow 209) are the same direction. Accordingly toner particles move from a point of contact of toner supply roller 208 and developing roller 210 to the direction of photoconductive roller 111. Latent image 1101 is thereby formed on a surface of photoconductive roller 111.

Further, developing blade 213 regulates a thickness of a toner layer on the surface of developing roller 210, while charging the toner particles to enable them to adhere to the surface of photoconductive roller 111 easily. Thin uniform toner layer 1003 is thereby formed on the surface of developing roller 210.

Developing roller 210 continues to rotate on the axis thereof in the direction of arrow 212, whereby toner layer 1003 is carried to a position neighboring to photoconductive roller 111. Part of toner layer 1002 carried to the position neighboring to photoconductive roller 111 adheres to a surface of photoconductive roller 111 (toner particles denoted with "1101" in FIG. 11) corresponding to the latent image on photoconductive roller 111. Then toner particles not adhering to the surface of photoconductive roller 111 are carried to a portion of contact with toner supply roller 208 as residual toner 1102 by developing roller 210.

At this point, since toner supply roller 208 has the surface made of the sponge material, a dent is formed on toner supply roller 208 by a pressure applied from developing roller 210. Accordingly, toner supply roller 208 and developing roller 210 contacts with faces thereof. It is thereby possible to have a portion of contact where the toner is supplied form toner supply roller 208 to developing roller 210, and another portion of contact where the toner is supplied from developing roller 210 to toner supply roller 208.

Residual toner 1201 carried to the portion of contact of toner supply roller 208 and developing roller 210 is removed from developing roller 210 by toner supply roller 208, and enters pores on the surface of toner supply roller 208 and adheres thereto. Since toner supply roller 208 rotates on the axis thereof in same direction as the rotation of developing roller 210, the force of contact and the fraction between toner supply roller 208 and developing roller 210 becomes large. The toner is thereby removed from developing roller 210 by toner supply roller 208 efficiently. Further, since toner supply roller 208 is in contact with developing roller 210 in the dent thereof, the force of contact and the fraction between toner supply roller 208 and developing roller 210 becomes larger.

Then residual toner 1201 adhering to toner supply roller 208 is carried to the portion of contact with developing roller 210 again and reused.

Thus, since toner supplying roller 208 not only supplies the toner but also removes the residual toner, it is possible to decrease the number of components of the apparatus, and consequently to perform miniaturization and cost-down of the apparatus.

The procedures of recycling the toner cartridge according to the above embodiment are explained herein.

First, used toner cartridges are collected in a collect center in corporation with, for example, users and service people. Next, the used toner cartridges collected in the collect center at each place are transported to a cartridge recycling plant. The collected used toner cartridges are sorted for each type of the apparatus, and the sorted toner cartridges are dissembled, and components are removed. The removed components are inspected to select reusable components, and components with the life expired or components that are not appropriate for reuse due to damage thereof. The components selected as appropriate for reuse are only cleaned to enable them to be reused as new cartridge components. Then the cleaned components are inspected whether they function sufficiently, in other words, can be reused, and by using the components passing the inspection, a new toner cartridges is assembled.

Then a film is pasted over a toner storage box of the new assembled toner cartridge, and the toner is refilled in the toner storage box from a toner filling opening. After the toner is refilled, the toner filling opening is capped. Then toner supply roller 208 is attached, and covered with the shutter, whereby the recycling procedures are completed.

Thus, if the toner is consumed in the toner storage box, refilling the toner in the storage box enables the toner cartridge to be reused. It is thereby possible not only to reduce the financial burden of users, but also to achieve resource saving, energy saving, and decreased waste.

Further it may be possible to collect only the first unit of the toner cartridge, and reuse only the first unit as described above. The recycling of the toner cartridge is thereby simplified.

In addition, it may be possible not to dissemble the toner cartridge into each component, and just to replenish the toner in the toner storage box. The recycling of the toner cartridge is thereby further simplified. In this case, it is necessary to prevent the toner from leaking from the opening. For this, it is necessary to remove toner supply roller 208 before refilling the toner, and to paste the film over the opening. After the film is pasted over the opening, toner supply roller 208 is attached again.

Further it may be possible for a consumer to buy the first unit to exchange with an used first unit, and to reuse only the second unit. It is thereby not necessary to collect the first unit.

As described above, according to toner cartridge 110 according to the above embodiment, toner supply roller 208 functions as a cap to prevent the toner from leaking from toner storage box 201. Therefore the toner does not leak from the toner storage box 201 at the time of exchanging the toner cartridge 110. Moreover since the soft porous material composing the surface of toner supply roller 208 has the high toner-holding capability, not only the toner-carrying capability of toner supply roller 208 is improved, but also the toner supply roller 208 prevents the toner from leaking from toner storage box 201 effectively. Further since toner supply roller 208 composed as described above is produced inexpensively, the toner cartridge is produced inexpensively, and the finical burden of users is suppressed.

Moreover since in toner supply roller 208 according to the above embodiment, the soft porous material of the surface thereof is composed of the sponge material, toner supply roller 208 is produced further inexpensively. Further since the sponge material is processed easily, toner supply roller 208 can be produced conveniently.

Furthermore since toner cartridge 110 according to the above embodiment is provided with shutter 302, when separated into first unit 301 and second unit 401, shutter 302 can over toner supply roller 208. It is thereby possible to prevent the toner from leaking from toner storage box 201 further assuredly.

Moreover according to the above embodiment, toner supply roller 208 removes the residual toner on the surface of developing roller 210. Developing roller 210 thereby forms a uniform toner layer assuredly, whereby the developing is assuredly performed. Thus, toner supply roller 208 functions as the cap to prevent the toner from leaking from toner storage box 201, supplies the toner to developing roller 210, and removes the residual toner on the surface of developing roller 210. Therefore, it is possible to produce toner cartridge 110 in expensively, and to miniaturize the apparatus.

Further according to the toner cartridge according to the above embodiment, since toner supply roller 208 and developing roller 210 rotate in the same direction, the force of contact and the friction between toner supply roller 208 and developing roller 210 is increased. The toner is thereby supplied from toner supply roller 208 to developing roller 210 effectively. In addition, toner supply roller 208 is in contact with developing roller 210 with the dent thereof, whereby the force of contact and the friction between toner supply roller 208 and developing roller 210 is further increased.

Furthermore according to the above embodiment, developing blade 213 charges the toner, while forming a generally uniform toner layer on the surface of developing roller 210. The toner layer thereby becomes apt to adhere to the surface of developing roller 210, whereby the toner layer is formed on developing roller 210 assuredly. Further, since developing blade 213 makes the toner layer on the surface of developing roller 210 uniform, the developing is further performed assuredly.

Moreover the toner cartridge according to the above embodiment is separable into first unit 301 having toner storage box 201 and toner supply roller 208, and second unit 401 having developing roller 210, whereby it is possible to separate toner storage box 201 that requires frequency exchange and developing roller 210 that has long life and is expensive into different units. Therefore it is possible to exchange only components that require frequent exchange, and to reuse expensive developing roller 210 with long-life. As a result, the financial burden of users is further suppressed.

Further since the toner cartridge according to the above embodiment has photoconductive roller 111 at a position neighboring to developing roller 210, the toner cartridge can be applied to an image forming apparatus without photoconductive roller 111. Since the toner is supplied from developing roller 210 to photoconductive roller 111 assuredly, the toner image is assuredly formed on photoconductive roller 111.

Furthermore toner cartridge 110 according to the above embodiment can be fixed to image forming apparatus 101, whereby it is possible to achieve image forming apparatus 101 capable of using toner cartridge 110.

Still furthermore toner cartridge 110 according to the above embodiment can be reused when the toner is consumed in toner storage box 201, by replenishing the toner in toner storage box 201. It is thereby possible not only to reduce the financial burden of users, but also to save resource and energy, and decrease waste.

In addition, while the above embodiment explains the case where first unit 301 is provided with toner storage box 201, toner supply roller 208, film 203 and others, and second unit 401 is provided with developing roller 210, photoconductive roller 111, charging roller 215, cleaning blade 217, used toner storage box 218 and others, the separating scheme is not limited to such a case. For example, the case is considered that a second unit does not have photoconductive roller 111.

Further while the above embodiment explains the case where the toner cartridge has toner storage box 201, toner supply roller 208, developing roller 210, photoconductive roller 111 and others, the present invention is not limited to such a case where the toner cartridge has all the components as described above. For example, it may be possible for the toner cartridge to have toner storage box 201 and toner supply roller 208 without having developing roller 210 and photoconductive roller 111, or for the toner cartridge to have toner storage box 201, toner supply roller 208 and developing roller 210 without having photoconductive roller 111.

In addition, in the above embodiment, toner cartridge 110 is applied to image forming apparatus 101 having only the image forming function, but may be applied to any apparatus having the image forming function such as a facsimile apparatus.

The present invention is not limited to the above described embodiments, and various variations and modifications may be possible without departing from the scope of the present invention.

This application is based on the Japanese Patent Application No. HEI11-293277 filed on Oct. 15, 1999, entire content of which is expressly incorporated by reference herein.

What is claimed is:

1. A toner cartridge, comprising:

a toner storage container that has an opening that supplies toner particles;

a toner supply roller that has a roller shaft provided with a cover roller of a soft porous material, said toner supply roller being positioned so that said toner supply roller covers the opening of said toner storage container; and a developing roller that is supplied with the toner particles from said toner supply roller, said developing roller being positioned in contact with said toner supply roller.

2. The toner cartridge according to claim 1, wherein said toner supply roller and said developing roller rotate in a same direction.

3. The toner cartridge according to claim 1, wherein the soft porous material comprises a sponge material.

4. The toner cartridge according to claim 1, wherein said toner supply roller removes residual toner particles on a surface of said developing roller.

5. The toner cartridge according to claim 1, wherein a photoconductive material, on which a latent image is formed, is positioned adjacent to said developing roller.

6. An image forming apparatus comprising:

the toner cartridge according to claim 1; and a fixing member that fixes the toner cartridge to the image forming apparatus.

7. A toner cartridge comprising:

a first unit comprising a toner storage container having an opening that supplies toner particles, and a toner supply roller positioned so that the toner supply roller covers the opening of the toner storage container; and a second unit comprising a developing roller that is supplied with the toner particles from the toner supply roller, said developing roller contacting said toner supply roller, said first unit and said second unit are configured to be separable from each other.

8. The toner cartridge according to claim 7, further comprising:

a shutter capable of moving to cover the toner supply roller when said first unit and said second unit are separated.

9. The toner cartridge according to claim 7, wherein the toner supply roller rotates in the same direction as the developing roller.

10. The toner cartridge according to claim 7, wherein said second unit includes a photoconductive material, on which a latent image is formed, adjacent to the developing roller.

11. The toner cartridge according to claim 7, wherein, when the toner particles in the toner storage container are consumed, only said first unit is exchanged.

12. The toner cartridge according to claim 7, wherein the toner supply roller comprises a roller shaft coated with a soft porous material covering.

13. The toner cartridge according to claim 12, wherein the soft porous material is a sponge material.

14. An image forming apparatus comprising:

the toner cartridge according to claim 7; and a fixing member that fixes the toner cartridge to the image forming apparatus.

15. A toner filling method for filling the toner cartridge according to claim 7, comprising:

removing the toner supply roller from the toner storage container;

filling the toner storage container with particles; and attaching the toner supply roller to the toner storage container.

* * * * *